US008726808B1

(12) United States Patent
Nance

(10) Patent No.: US 8,726,808 B1
(45) Date of Patent: May 20, 2014

(54) INITIATOR ASSEMBLY HAVING LOW-ENERGY EXPLODING FOIL INITIATOR HEADER AND COVER WITH AXIALLY THREADED PORTION

(75) Inventor: Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 13/328,237

(22) Filed: Dec. 16, 2011

Related U.S. Application Data

(60) Provisional application No. 61/424,463, filed on Dec. 17, 2010.

(51) Int. Cl.
*F42B 3/10* (2006.01)
*F42B 3/12* (2006.01)
*F42B 3/185* (2006.01)

(52) U.S. Cl.
USPC ..... 102/202.7; 102/202.14

(58) Field of Classification Search
USPC ..... 102/202.5, 202.7, 202.9, 202.12, 102/202.14
See application file for complete search history.

(56) References Cited

U.S. PATENT DOCUMENTS 3,960,083 A * 6/1976 Dietzel et al. ..... 102/202.14
4,128,058 A * 12/1978 Mixon et al. ..... 102/202.14
4,144,814 A * 3/1979 Day et al. ..... 102/202.13
4,316,412 A * 2/1982 Dinegar et al. ..... 102/202.5
5,088,412 A * 2/1992 Patrichi ..... 102/202.13
6,047,643 A 4/2000 Benner et al.
6,923,122 B2 8/2005 Hennings et al.
7,543,532 B2 6/2009 Nance
7,552,680 B2 6/2009 Nance et al.
7,581,496 B2 9/2009 Hennings et al.
7,661,362 B2 2/2010 Hennings et al.
7,762,189 B2 * 7/2010 Ritchie et al. ..... 102/202.7
7,921,774 B1 4/2011 Reynolds et al.
7,987,787 B1 * 8/2011 Sudick ..... 102/202.1
8,037,823 B2 * 10/2011 Ritchie et al. ..... 102/202.5
8,100,043 B1 1/2012 Nance et al.
8,113,117 B2 2/2012 Nance

* cited by examiner

*Primary Examiner* — James Bergin
(74) *Attorney, Agent, or Firm* — Harness, Dickey & Pierce, P.L.C.

(57) ABSTRACT

An initiator assembly that includes a header body, an insulating spacer that is coupled to the header body, an initiator, a plurality of terminals that extend through the header body, a plurality of contacts, an input charge, an output charge and a cover that includes an axially threaded portion into which the output charge is housed. The initiator includes a plurality of electric interfaces and is disposed on a side of the insulating spacer opposite the header body. The contacts electrically couple the electric interfaces to the terminals. The input charge is formed of a secondary explosive and is disposed proximate the initiator so as to be capable of detonating to release energy upon activation of the initiator. The cover is coupled to the header body and cooperates with the header body to house the insulating spacer, the initiator chip, the contacts, the input charge and the output charge.

20 Claims, 3 Drawing Sheets

INITIATOR ASSEMBLY HAVING LOW-ENERGY EXPLODING FOIL INITIATOR HEADER AND COVER WITH AXIALLY THREADED PORTION

CROSS-REFERENCE TO RELATED APPLICATIONS

This application claims the benefit of U.S. Provisional Patent Application No. 61/424,463 filed Dec. 17, 2010, the disclosure of which is incorporated by reference as if set forth herein in its entirety.

FIELD

The present disclosure relates to devices for initiating combustion, deflagration and/or detonation events.

Modern initiators, such as detonators, commonly employ materials including ceramics and stainless steels in their construction. These materials are typically selected to provide the initiator with a degree of robustness that permits the initiator to withstand extreme changes in temperature and humidity, as well as to resist oxidization. While modern initiator configurations are generally satisfactory for their intended purposes, they are nonetheless susceptible to improvement.

SUMMARY

This section provides a general summary of the disclosure, and is not a comprehensive disclosure of its full scope or all of its features.

In one form the present teachings provide an initiator assembly that includes a header body, an insulating spacer that is coupled to the header body, an initiator, a plurality of terminals that extend through the header body, a plurality of contacts, an input charge, an output charge and a cover. The initiator forms at least a portion of an exploding foil initiator and includes a plurality of electric interfaces. The initiator is disposed on a side of the insulating spacer opposite the header body. The contacts electrically couple the electric interfaces to the terminals. The input charge is formed of a secondary explosive and is disposed proximate the initiator so as to be capable of detonating to release energy upon activation of the initiator. The output charge is formed of an energetic material and is configured to at least one of detonate, deflagrate and combust in response to receipt of energy released from detonation of the input charge. The cover is coupled to the header body and cooperates with the header body to house the insulating spacer, the initiator chip, the contacts, the input charge and the output charge. The cover includes an axially threaded portion into which the output charge is housed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
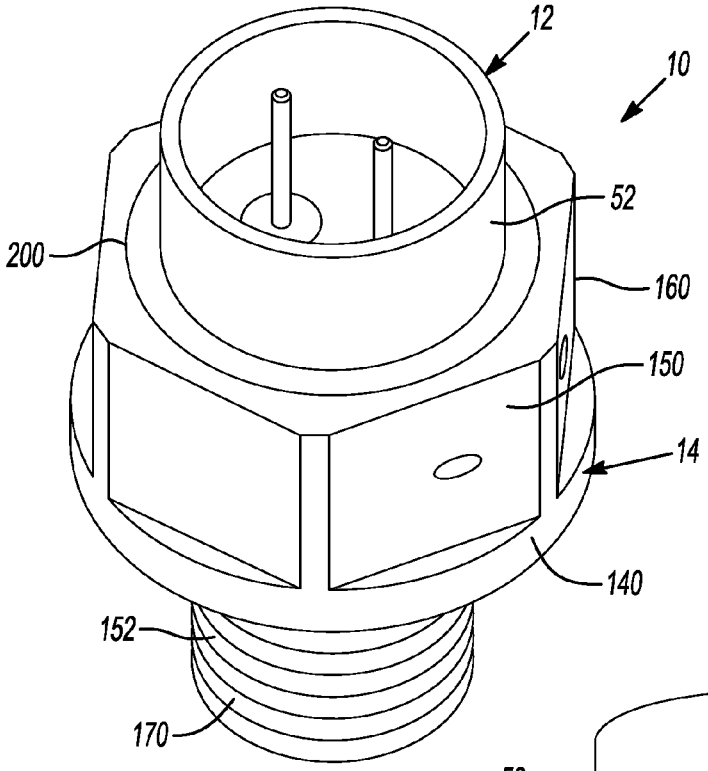
FIG. 1 is a rear perspective view of an initiator assembly constructed in accordance with the teachings of the present disclosure.
Figure 2:
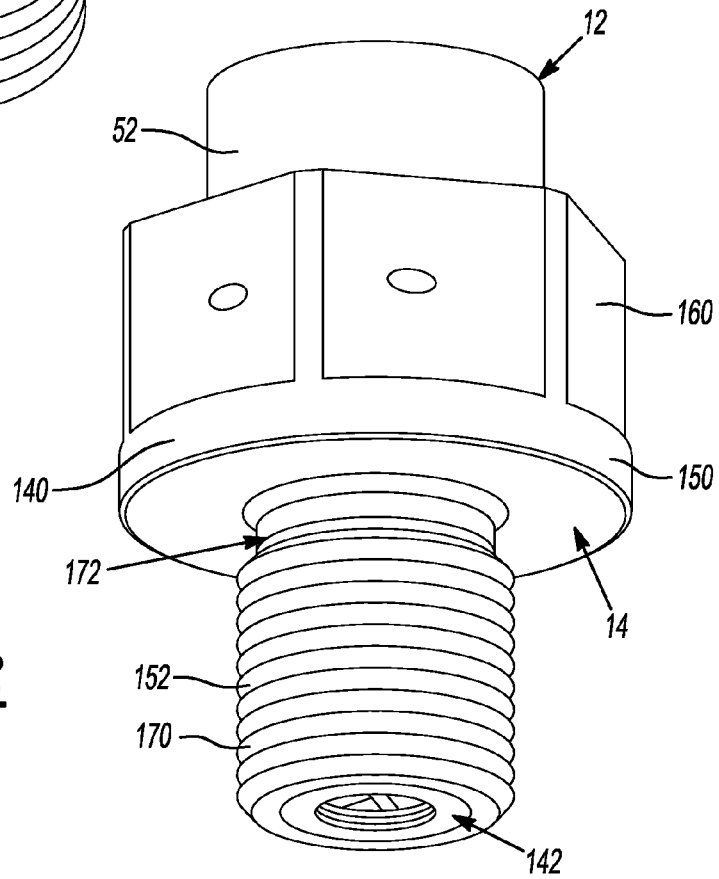
FIG. 2 is a front perspective view of the initiator assembly of FIG. 1.
Figure 3:
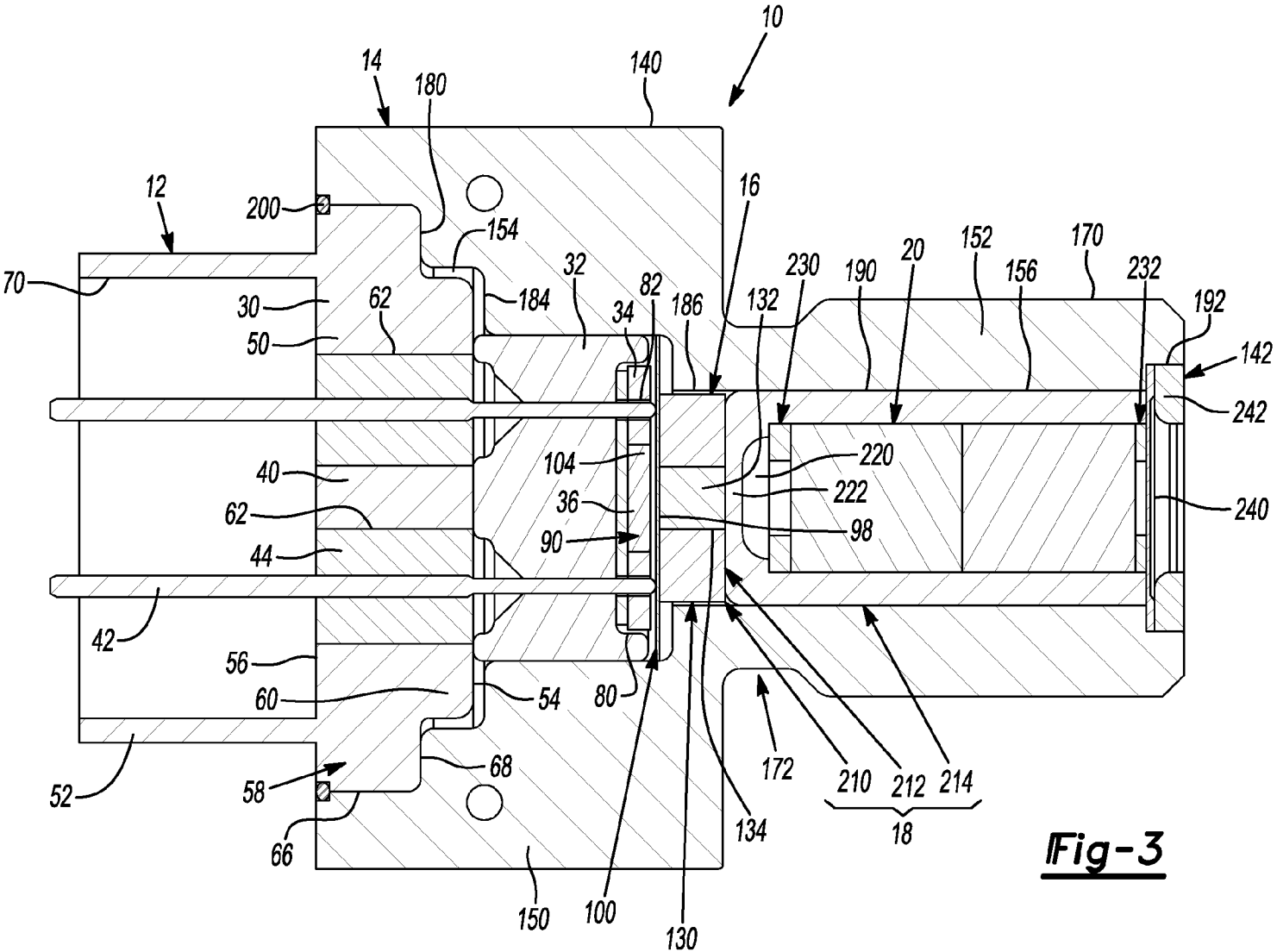
FIG. 3 is a longitudinal section view of the initiator assembly of FIG. 1.
Figure 4:
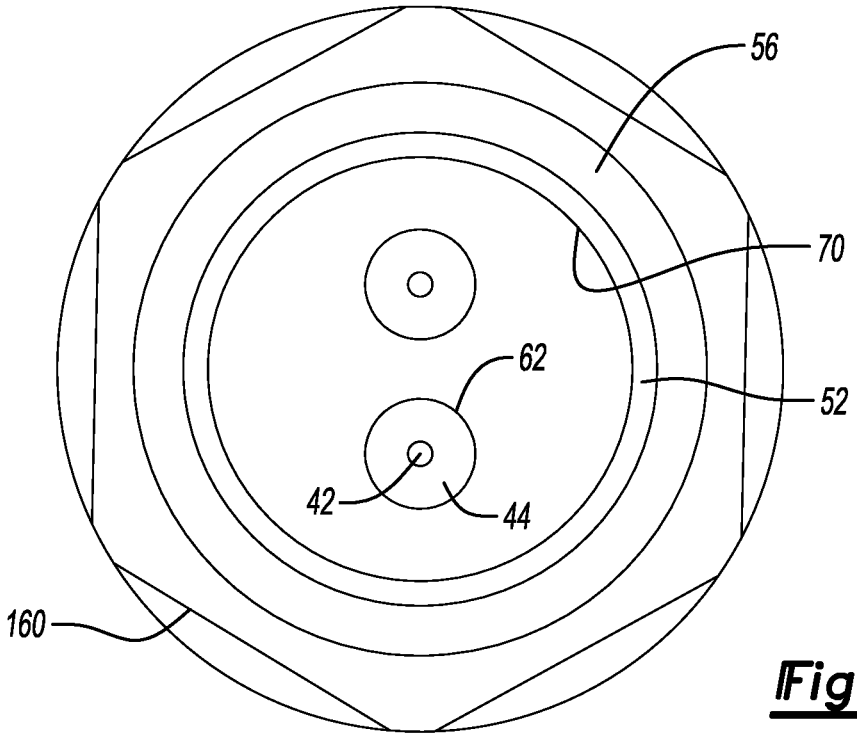
FIG. 4 is a rear elevation view of the initiator assembly of FIG. 1.
Figure 5:
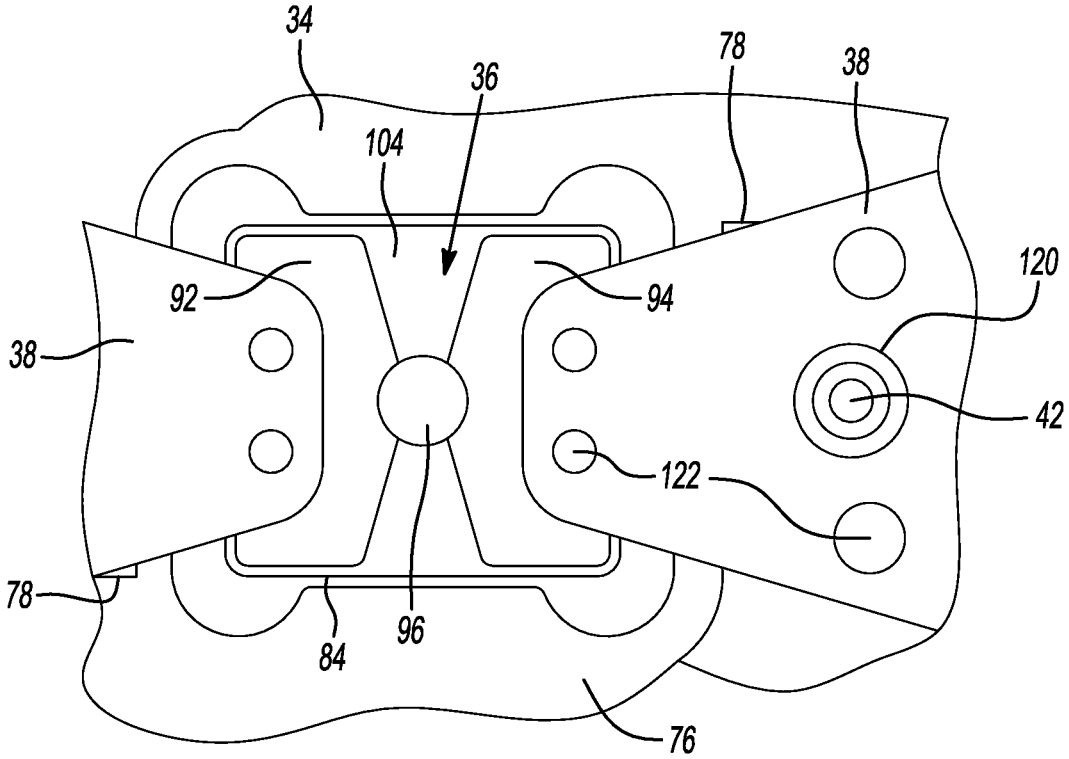
FIG. 5 is an elevation view of a portion of the initiator assembly of FIG. 1, illustrating an initiator, contacts and a frame member of a header body in more detail.

With reference to FIGS. 1 through 3 of the drawings, the initiator assembly 10 can include a header assembly 12, a cover or housing assembly 14, an input pellet assembly 16, a barrier system 18 and an output charge 20. The header assembly 12 can include a header 30, an insulating spacer 32, a frame member 34, an initiator 36 and a plurality of contacts 38 (FIG. 5). The header 30 can include a header body 40, a plurality of terminals 42 and a plurality of seal members 44.

The header body 40 can be formed of an appropriate material, such as KOVAR®, and can be shaped in a desired manner. In the particular example provided, the header body 40 includes a body portion 50 and a shroud member 52. The body portion 50 can define a first axial end face 54, a second (opposite) axial end face 56, a shoulder 58, a nose 60 and a plurality of seal apertures 62 that can extend through and between the first and second axial end faces 54 and 56. The shoulder 58 can have a radially outer surface 66 and an abutting face 68 that can be generally perpendicular to the radially outer surface 66. The radially outer surface 66 can have any desired shape, but in the particular example provided is generally cylindrical. The nose 60 can extend between the shoulder 58 and the first axial end face 54 and can be sized somewhat smaller in diameter than the radially outer surface 66 to thereby form the abutting face therebetween. The shroud member 52 can be fixedly coupled to (e.g., integrally formed with) the body portion 50 and can encircle the terminals 42 to at least partially shroud the terminals 42 and/or to provide a datum surface 70 that is adapted for use in guiding terminals (not shown) in a mating connector (not shown) into engagement with the terminals 42.

The terminals 42 can be received through respective ones of the seal apertures 62 and can have a first portion 42-1 and a second portion 42-2. The first portion 42-1 can be formed of a first diameter, while the second portion 42-2 can have second, smaller diameter that is configured to encourage buckling of the terminal 42 should an axial load be applied to the terminal 42. The seal members 44 can be formed of a suitable material, such as glass conforming to 2304 Natural or another dielectric material, and can be received into the seal apertures 62 coaxially about the terminals 42. The seal members 44 can sealingly engage the body portion 50 as well as the first portion 42-1 of the terminals 42 so as to form a relatively strong seal, such as a seal that will leak at a rate less than about $1\times10^{-5}$ or $1\times10^{-6}$ cc/min when one side of the header body 40 is exposed to helium gas at a gauge pressure of about one atmosphere while the other side of the header body 40 is exposed to atmospheric pressure (i.e., a gauge pressure of zero).

The insulating spacer 32 can be formed of a suitable dielectric material, such as polycarbonate, synthetic resin bonded paper, or epoxy resin bonded glass fabric, and can have a plurality of clearance apertures C that are sized to receive the terminals therethrough. At least one pocket can be formed in the insulating spacer 32 to provide space for one or more of the terminals 42 to buckle when an axially-directed force is applied to an end of the second portion 42-2 of the terminals 42 that is opposite the first portion 42-1. In the particular example provided, each of the clearance apertures P has an enlarged portion EP that is positioned on a side adjacent the first axial face 54 of the header body 40 and which provides space for the second portion 42-2 of a corresponding one of the terminals 42 to buckle. The insulating spacer 32 can be formed in a manner that is described in U.S. Pat. No. 7,430,963, the disclosure of which is hereby incorporated by reference as if fully set forth in detail herein. The insulating spacer 32 can be abutted against the first axial face 54 of the header body 40.

With reference to FIGS. 3 and 5, the frame member 34 can include a body 76 and a plurality of electrical conductors 78. The body 76 can be formed of an appropriate dielectric material, such as synthetic resin bonded paper or epoxy resin bonded glass fabric. The conductors 78 can be arranged about the body 76 in a predetermined manner and can comprise one or more conductive layers of material, such as gold, silver, copper, nickel and alloys thereof. The conductors 78 can be formed onto the body 76 in any desired manner, such as through metallization of the entire surface of the body 76 and acid-etch removal of portions of the metallization that are not desired. The frame member 34 can be sized and shaped to closely conform to a pocket 80 in the size and shape of the insulating spacer 32 and can include a plurality of terminal apertures 82 and an interior aperture 84 that is sized to receive the initiator 36. The terminal apertures 82 can be sized to receive a corresponding one of the terminals 42 therein.

The initiator 36 can be constructed in a manner that is disclosed in U.S. patent application Ser. Nos. 11/431,111 and 11/430,944 entitled "Full Function Initiator With Integrated Planar Switch" the disclosures of which are hereby incorporated by reference as if fully set forth in detail herein. For example, the initiator 36 can include at least a portion of an exploding foil initiator 90, such as first and second bridge contacts 92 and 94, respectively, a bridge 96, a flyer 98 and a barrel layer 100. In the particular example shown, the first and second bridge contacts 92 and 94, the bridge 96, the flyer 98 and the barrel layer 100 are fixedly mounted on a substrate 104 that is received in the interior aperture 84 formed in the frame member 34 and fixedly coupled to the frame member 34, but it will be appreciated that the first and second bridge contacts 92 and 94, the bridge 96, the flyer 98 and the barrel layer 100 can be mounted directly to the frame member 34 in the alternative. The flyer 98 can be received between the bridge 96 and the barrel layer 100 and can be formed of a suitable material, such as polyamide. The barrel layer 100 can be formed of a suitable electrically insulating material, such as polyamide. The barrel layer 100 can cover the frame member 34 and the contacts 38 to electrically isolate these elements from the input pellet assembly 16. Additionally, the barrel layer 100 can define a barrel aperture (not specifically shown) through which the flyer 98 may be expelled when the initiator 36 is activated. In this regard, it will be appreciated that the barrel aperture, the flyer 98 and the bridge 96 are disposed in-line with one another.

If desired, an adhesive, such as SCOTCH-WELD™ EC-2216 Grey epoxy marketed by Minnesota Mining and Manufacturing Company of St. Paul, Minn., can be employed to bond the frame member 34 and the initiator 36 to the insulating spacer 32 as well as to bond the insulating spacer 32 to the first axial face 54 of the header body 40 so that a front surface of the initiator 36 will be substantially parallel and co-planar with a front surface of the frame member 34.

The contacts 38 can be formed of a suitable electrically conductive material, such as KOVAR® having a thickness of about 0.003 inch, and can include a terminal aperture 120 that can receive an associated one of the terminals 42 and a plurality of solder apertures 122. The contacts 38 can be shaped to engage an associated electric interface (e.g., the first bridge contact 92, the second bridge contact 94). In the particular example provided, the contacts 38 are soldered to an associated one of the terminals 42 and an associated one of the electric interfaces with an appropriate solder, such as a F540SN62-86D4 solder paste marketed by Heraeus Inc., Circuit Materials Division of Scottsville, Ariz. The solder apertures 122 permit solder to flow through the contacts 38 in predetermined areas, such as locations in-line with the associated electric interfaces and in-line with the conductors 78 of the frame member 34. Accordingly, it is possible to visually-inspect the solder joints associated with each contact 389 through the solder apertures 122 and the terminal aperture 120.

It will be appreciated that the thicknesses of the barrel layer 100, the contacts 38 and the solder that couples the contacts 38 to the terminals 42 and the first and second bridge contacts 92 and 94 is selected to space the bridge 96 apart from the input pellet assembly 16 by a predetermined spacing, such as about 0.004 inch to about 0.008 inch. It will be also appreciated that it can be important in some situations that the contacts 38 be relatively flat so as not to affect the spacing between the bridge 96 and the input pellet assembly 16.

The input pellet assembly 16 can comprise an input sleeve 130 and an input charge 132. The input sleeve 130 can be configured to support the input charge 132 and direct energy from the input charge 132 in a desired direction. In the particular example provided, the input sleeve 130 is formed of a suitable steel and defines a cavity 134 that can be located in-line with the bridge 96. The input sleeve 130 can be sized relatively smaller than the size of the nose 60 and the insulating spacer 32 so as to permit the input sleeve 130 to be packaged in the housing assembly 14 as will be described in more detail, below. The input charge 132 can be formed of a suitable energetic material, such as RSI-007, which is available from Reynolds Systems, Inc. of Middletown, Calif. The input charge 132 can be received in the cavity 134 in the input sleeve 130 and compacted to a desired density. It will be appreciated that in some applications, the input charge 132 may fill the entire volume of the cavity 134. It will also be appreciated that in some applications the input sleeve 130 may be deleted.

With reference to FIGS. 1 through 4, the housing assembly 14 can include a housing 140 and a closure member 142. The housing 140 can be formed of a suitable material, such as KOVAR®, and can comprise a first housing portion 150, a second housing portion 152, a first internal bore 154 and a second internal bore 156.

The first housing portion 150 can define an outer surface 160 that can have a desired shape, such as a non-circular shape, that permits a tool to be engaged to the first housing portion 150 to install the initiator 36 to a device. In the example provided, the outer surface 160 has a generally hexagonal shape that defines a plurality of wrench flats that permit the housing 140 to be engaged by a wrench or socket to install the initiator assembly 10.

The second housing portion 152 can be integrally formed with and can extend forwardly from the first housing portion 150. The second housing portion 152 can define a plurality of external threads 170 and an undercut 172 that is disposed axially between the first housing portion 150 and the external threads 170 and which can be sized at or smaller than the minor diameter of the threads 170. The threads 170 can be sized in a desired manner, and may have a major diameter that is less than or equal to ½ (0.50) inch, such as less than or equal to ⅜ (0.38) inch.

The first internal bore 154 can include first and second counterbores 180 and 182, respectively, and a rear bore portion 186, while the second internal bore 156 can comprise a forward bore portion 190 and an end counterbore 192. The first counterbore 180 can be sized to receive the shoulder 58 of the body portion 50 of the header body 40, the second counterbore 182 can be sized to receive the nose 60 of the body portion 50 of the header body 40 and the rear bore portion 186 can be sized to receive the insulating spacer 32, the initiator 36 and the input pellet assembly 16. The first internal bore 154 can be sized to provide clearance in an axial direction between the housing 140 and the first axial end face 54 of the header body 40 and between the housing 140 and the barrel layer 100. Radial clearance may also be provided between the nose 60 and the housing 140. The radially outer surface 66 of the shoulder 58 can be configured to engage the housing 140 via an interference fit to aid in aligning the header assembly 12 to the housing 140. A weld 200 may be employed at the joint where the radially outer surface 66 of the shoulder 58 is engaged to the housing 140 to fixedly couple and hermetically seal the header assembly 12 to the housing 140. It will be appreciated that the weld 200 can be positioned on an end of the initiator 36 that is not critical to the operation of the initiator assembly 10.

The second internal bore 156 can be coaxial with the first internal bore 154. In the example provided, the second internal bore 156 is contiguous with the first internal bore 154 such that the same machining or forming tool may be employed to form all or portions of both (e.g., portions of the rear and forward bore portions 186 and 190 that intersect one another). It should be appreciated, however, that a portion of the housing 140 may be disposed between the first and second internal bores 154 and 156 such that an internal wall (not shown) divides or separates the first internal bore 154 from the second internal bore 156. In this alternate configuration the internal wall could be employed as a portion of the barrier system. The end counterbore 192 can be sized to receive the closure member 142.

The barrier system 18 can be employed to separate the input charge 132 from the output charge 20. In the particular example provided, the barrier system 18 includes a first barrier member 210, a second barrier member 212 and a barrier cup 214. The first barrier member 210, which can be abutted against the input sleeve 130, can be a formed of a reactive material, which may be a metal, such as titanium, or another suitably reactive material that is inert under normal circumstances. The second barrier member 212, which can be abutted against the first barrier member 210, can be formed of an oxidizable material, such as polytetrafluoroethylene. The positions of the first and second barrier members 210 and 212 can be reversed and/or additional pieces of the first barrier member 210 and/or the second barrier member 212 may be employed. The barrier cup 214 can define a cup-like structure that can be received within the forward bore portion 190 (e.g., engaged to the second housing portion 152 via an interference fit) and axially abutted against the first and second barrier members 210 and 212 on a side opposite the input pellet assembly 16. The barrier cup 214 can include an interior aperture 220, which can receive the output charge 20 as will be discussed in more detail, below, that can be bounded on its rear side by an end wall 222. The end wall 222 can have a thickness that can be tailored in a desired manner. In the particular example provided, a central portion of the end wall 222 is relatively thinner than a remaining portion of the material that forms the barrier cup 214.

The output charge 20 can be formed of any suitable energetic material, such as boron potassium nitrate ($BKNO_3$) or titanium hydride potassium perchlorate (THPP) and can be received into the interior aperture 220 in the barrier cup 214. In some situations, the output charge 20 can be pre-compacted into a pellet and assembled as one or more discrete pellet components into the interior aperture 220 in the barrier cup 214. Alternatively, the material that forms the output charge 20 can be compacted directly in the interior aperture 220 in the barrier cup 214. Also alternatively, the barrier cup 214 could be omitted altogether and the output charge 20 can be inserted directly into the forward bore portion 190 in the housing 140.

One or more resilient elements can be employed to dampen vibration transmitted axially through the output charge 20. In the particular example provided, a first resilient element 230 is disposed between the output charge 20 and the end wall 222 and a second resilient element 232 is disposed between the output charge 20 and the closure member 142. The first and second resilient elements 230 and 232 can be formed of a suitable material, such as silicone rubber, and can have a desired shape with or without one or more apertures to attenuate energy from released into or out from the barrier cup 214. In the example provided, each of the first and second resilient elements 230 and 232 has an annular shape.

The closure member 142 can include a cover body 240, which can be formed of a suitable material, such as KOVAR®, and a rim 242. The cover body 240 can be a disk-like structure that can received in the forward bore portion 190 and abutted against a distal end of the barrier cup 214 and against the second resilient element 232. The rim 242 can be received into the end counterbore 192 and abutted against the cover body 240. The rim 242 can be welded to the second housing portion 152 in an appropriate manner (e.g., laser welded) to fixedly and sealingly couple the closure member 142 to the housing 140. It will be appreciated that a preload force can be applied to the closure member 142 to seat the cover body 240 to the housing 140 and as such, various components of the initiator assembly 10, such as the output charge 30, the barrier system 18, the frame member 34 and the initiator 36 can be maintained in a state of compression.

It will be appreciated from the foregoing discussion and appended drawings that the output charge 20 can be packaged into the initiator assembly 10 in a relatively compact manner, such as in an axially forward portion of the housing 140 of the initiator assembly 10 within a volume that is smaller on its radially outer surface than the minor diameter of a portion of the housing 140 that is threaded into another component (e.g., bulkhead).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

a header assembly having a header body, an insulating spacer that is coupled to the header body, an initiator, a plurality of terminals that extend through the header body, and a plurality of contacts, the initiator forming at least a portion of an exploding foil initiator, the initiator including a plurality of electric interfaces, the initiator being disposed on a side of the insulating spacer opposite the header body, the contacts electrically coupling the electric interfaces to the terminals;

an input charge formed of a secondary explosive and being disposed proximate the initiator so as to be capable of detonating to release energy upon activation of the initiator;

an output charge formed of an energetic material, the output charge being configured to at least one of detonate, deflagrate and combust in response to receipt of energy released from detonation of the input charge; and a cover that is fixedly coupled to the header body, the cover cooperating with the header body to house the insulating spacer, the initiator, the contacts, the input charge and the output charge, wherein the cover comprises an externally threaded portion into which the output charge is housed.

2. The initiator assembly of claim 1, wherein the cover and the header assembly cooperate to define a hermetically sealed chamber in which the input charge is received.

3. The initiator assembly of claim 2, wherein the header body is welded to the cover.

4. The initiator assembly of claim 1, wherein the threaded portion has a major diameter that less than or equal to ½ inch.

5. The initiator assembly of claim 4, wherein the major diameter of the threaded portion is less than or equal to ⅜ inch.

6. The initiator assembly of claim 1, wherein the cover defines first and second counterbores, wherein the header body has first and second axially spaced apart end faces, wherein the first axial end face is seated against the first counterbore and wherein the second axial end face is axially spaced apart from the second counterbore.

7. The initiator assembly of claim 1, wherein each of the terminals has a first terminal portion and a second terminal portion, and wherein the first terminal portion has a first diameter and the second terminal portion has a second diameter that is smaller than the first diameter.

8. The initiator assembly of claim 7, wherein the insulating spacer defines at least one pocket, wherein the at least one pocket provides space for at least one of the terminals to buckle if an axially-directed force is applied to an end of the second portion of the at least one of the terminals that is opposite the first portion.

9. The initiator assembly of claim 1, wherein the cover further comprises a first housing portion that is configured to receive the header assembly, and wherein an undercut is formed between the threaded portion and the first housing portion.

10. The initiator assembly of claim 1, wherein the cover comprises a housing and a closure member.

11. The initiator assembly of claim 10, wherein the closure member comprises a cover body and a rim.

12. The initiator assembly of claim 10, wherein a resilient element is disposed between the closure member and the output charge.

13. An initiator assembly comprising:

a weldment having an externally threaded portion, an internal cavity and a bore that extends out of an end of the threaded portion;

an insulating spacer received in the internal cavity;

an initiator that forms at least a portion of an exploding foil initiator, the initiator including a plurality of electric interfaces, the initiator being disposed on a side of the insulating spacer that faces the bore in the weldment;

a plurality of terminals that extend through the weldment into the internal cavity;

a plurality of contacts that electrically couple the electric interfaces to the terminals;

an input charge formed of a secondary explosive and being disposed proximate the initiator so as to be capable of detonating to release energy upon activation of the initiator; and an output charge received in the bore and being formed of an energetic material, the output charge being configured to at least one of detonate, deflagrate and combust in response to receipt of energy released from detonation of the input charge; and a closure member that is fixedly coupled to the weldment to close the bore, the output charge being disposed between the closure member and the initiator.

14. The initiator assembly of claim 13, wherein the threaded portion has a major diameter that less than or equal to ½ inch.

15. The initiator assembly of claim 14, wherein the major diameter of the threaded portion is less than or equal to ⅜ inch.

16. The initiator assembly of claim 13, wherein each of the terminals has a first terminal portion and a second terminal portion, and wherein the first terminal portion has a first diameter and the second terminal portion has a second diameter that is smaller than the first diameter.

17. The initiator assembly of claim 16, wherein the insulating spacer defines at least one pocket, wherein the at least one pocket provides space for at least one of the terminals to buckle if an axially-directed force is applied to an end of the second portion of the at least one of the terminals that is opposite the first portion.

18. The initiator assembly of claim 13, wherein a resilient element is disposed between the closure member and the output charge.

19. An initiator assembly comprising:

a header assembly having a header body, an insulating spacer that is coupled to the header body, an initiator, a plurality of terminals that extend through the header body, and a plurality of contacts, the initiator forming at least a portion of an exploding foil initiator, the initiator including a plurality of electric interfaces, the initiator being disposed on a side of the insulating spacer opposite the header body, the contacts electrically coupling the electric interfaces to the terminals, each of the terminals has a first terminal portion and a second terminal portion, wherein the first terminal portion has a first diameter and the second terminal portion has a second diameter that is smaller than the first diameter;

an input charge formed of a secondary explosive and being disposed proximate the initiator so as to be capable of detonating to release energy upon activation of the initiator;

an output charge formed of an energetic material, the output charge being configured to at least one of detonate, deflagrate and combust in response to receipt of energy released from detonation of the input charge; and a cover that is welded coupled to the header body, the cover cooperating with the header body to form a hermetically sealed cavity that houses the insulating spacer, the initiator, the contacts, the input charge and the output charge, wherein the cover comprises an exterior threaded portion into which the output charge is housed, the threaded portion having a major diameter that is less than or equal to ½ inch, wherein the cover defines first and second counterbores, wherein the header body has first and second axially spaced apart end faces, wherein the first axial end face is seated against the first counterbore and wherein the second axial end face is axially spaced apart from the second counterbore.

20. The initiator assembly of claim 19, wherein the major diameter of the threaded portion is less than or equal to ⅜ inch.

* * * * *